United States Patent [19]

Lowe

[11] 4,014,763

[45] Mar. 29, 1977

[54] CATHODE AND HANGER BAR ASSEMBLY AND ELECTROLYSIS THEREWITH

[75] Inventor: Bryan Wilfred Hodson Lowe, Sutton Coldfield, England

[73] Assignee: Imperial Metal Industries (Kynoch) Limited, Birmingham, England

[22] Filed: Nov. 3, 1975

[21] Appl. No.: 628,557

[30] Foreign Application Priority Data

Nov. 8, 1974 United Kingdom ..... 48421/74

[52] U.S. Cl. ..... 204/106; 204/242; 204/286

[51] Int. Cl.² ..... C25C 1/12; C25C 7/02

[58] Field of Search ..... 204/280, 286, 288, 289, 204/106, 107, 108, 242

[56] References Cited

UNITED STATES PATENTS 3,857,774 12/1974 Morton et al. ..... 204/242

*Primary Examiner*—G. L. Kaplan
*Attorney, Agent, or Firm*—Cushman, Darby & Cushman

[57] ABSTRACT

A cathode in which the hanger bar is formed of titanium cored copper, the cathode being in the form of a continuous sheet of titanium spotwelded along one edge to the titanium core of the hanger bar. There may be an intermediate block between the titanium core and the continuous sheet.

13 Claims, 13 Drawing Figures

CATHODE AND HANGER BAR ASSEMBLY AND ELECTROLYSIS THEREWITH

BACKGROUND OF THE INVENTION

This invention relates to cathodes and has particular but not exclusive reference to cathodes for use in copper electrorefining and copper electrowinning.

Copper refining by electrolytic methods has been known for many years in which pure copper is electrodeposited at the cathode of an electrolytic cell in which the anode is a sacrificial impure copper anode and which is consumed during the electrolysis. It has been generally the practice in a first stage to electrodeposit a thin layer of pure copper onto a specially prepared mother plate, in a second stage to strip off the freshly deposited pure copper from the mother plate in the form of a thin sheet or starter sheet, and in a third stage to use this starter sheet as a cathode in another cell in which a further thick layer of pure copper is electrodeposited on the cathode. More recently, titanium has been used as the material for the mother plate in this process. A second process is to build up a thick deposit of pure copper directly onto a titanium cathode from which it is subsequently stripped as a thick plate, thereby eliminating the first and second stages of the previous process.

When titanium is used as a material for either the mother plate in the first process or the cathode in the second process, each mother plate or cathode is connected to the current carrying busbar by means of a hanger bar which stretches across the electrolytic cell and contacts the busbar located on one side (or both sides) of the cell. Previously, these hanger bars have been formed of copper and the connection between the copper and the titanium mother plate or cathode was by means of bolts or rivets. The electrical contact between the mother plate cathode (hereafter referred to simply as the cathode) and the hanger bar was found to be inconsistent. The cathode and hanger bar are tightly held in the vicinity of the bolts or rivets but elsewhere the surfaces became slightly separated. The separation occurred as a result of mechanical deformation, or differential thermal expansion. When a separation between hanger bar and sheet had been fomed, splashes of electrolyte were forced into the gaps, and on drying out, left crystals of, for example, copper sulphate in the gap. When the gap is closed by other deformations, the crystals prevent full closure. Further movement allows more material to build up in the gap and as a result, the gap is widened out by a ratcheting type of action. Clearly, the reduction of surface contact area resulted in an increase in resistance of the joint.

The old copper to copper joints were of high quality and the electrolyte splashes had a cleaning action on the copper. However, the electrolyte has no cleaning action on the titanium. Additionally, the surface oxide film formed on the titanium interface interferes with the electrical contact. The surface film tends to grow if the titanium is heated as a result of the resistance across the titanium copper interface. With the currents which have been used to date, the electrical contact problem has been solved by utilising a greater number of bolts or rivets to increase the electrical contact. Over the past five years or so, however, the use of higher currents in electrolytic refining has meant that serious problems of contact resistance have developed.

As many cathodes are used in parallel, and the current supplied is constant, if the resistance of one of them increases, it receives less current. Not only does this result in a lower rate of deposition on that cathode, it also increases the current passing through the remainder of the cathodes. This can cause the next higher resistance cathode to become over-loaded and to overheat, distort and increase in resistance. This results in a further increase in current through the remainder of the cathodes and a cascade of failures can then occur.

The heating of a cathode can, in addition to increasing the load upon the remainder of the cathodes, distort the cathode. Any small amount of distortion is compounded by extra local growth where the cathode approaches the anode. This can then result in nodular growth of deposit on the cathode with a rapid build-up of a deposit on the cathode, and a short between the cathode and anode.

Also, since the current loss in heating the joint between the cathode and the hanger bar is a complete waste of energy and consequently money, this factor has an important bearing on the economics of electrolytic refining. The heat generated also distorts the joint and the sheet.

A very elegant solution to the problems associated with these earlier cathodes has been proposed in which the hanger bar is in the form of a titanium-clad copper bar in which the copper is metallurgically bonded to the titanium. The main sheet of titanium is then spot-welded along one edge to the outer sheath of the hanger bar and the cathode then suffers from none of the problems mentioned above. The solution is clearly very elegant since it solves in one go the great majority of the previous problems. However, the product is relatively expensive to manufacture.

The product may be made by placing a copper billet in a titanium cylinder and placing a further copper sheath on the outside. Copper end lids are then welded to the copper outer sheath and the product is then extruded at a high temperature to metallurgically bond the copper and titanium and the outer copper layer is then pickled off. The round starting billet is extruded straightaway into a substantially rectangular shape. However, this results in an excess of titanium at the ends of the rectangle when seen in cross-section. The titanium is mainly needed at those points where spot-welding occurs and excess titanium at the ends is a waste. To enhance the strength of the hanger bar, it is necessary to cold work the product to harden the copper. It is not possible to cold draw the product since there is a danger of galling of the titanium on the die and special surface treatments would be needed. Since the product cannot be cold drawn, it is difficult to control the final dimensions.

It is necessary to remove the titanium sheath at the ends to enable proper electrical contact to be made with the busbars and if the hanger bar has to fit into a Baltimore groove, the starting size has to be sufficiently large to enable all of the titanium to be removed and still leave an inner core of sufficient size and shape to fit properly into the groove.

The majority of these problems are overcome by the present invention.

By "film-forming metal" as used herein is meant a metal chosen from the group titanium, niobium, zirconium, tantalum, hafnium, or alloys of these metals.

SUMMARY OF THE INVENTION

By the present invention there is provided a cathode and hanger bar assembly comprising a hanger bar of aluminum or copper having a core of a film-forming metal metallurgically bonded thereto, the aluminum or copper being relieved along the length of the hanger bar to reveal the film-forming metal, and a continuous sheet of a film-forming metal welded along one edge only to at least part of the metal core.

The continuous sheet may be welded to an intermediate block or blocks, the block or blocks being welded to the core; preferably the block or blocks are of a film-forming metal.

The aluminum or copper may be relieved at discrete locations along the length of the hanger bar, or alternatively the aluminum or copper may be relieved along the entire length of one or both sides.

In a further embodiment, the hanger bar is formed by manufacturing a film-forming metal cored copper or aluminum bar and cutting it longitudinally to reveal a surface of the film-forming metal along one edge. The continuous sheet is directly welded to the free edge of the film-forming metal. The continuous sheet may be cranked so as to overlie the free edge of the film-forming metal and to have a portion dependent below the cathode. Alternatively, the continuous sheet may be welded directly to the free edge of the film-forming metal and may depend directly from it.

The block or blocks are preferably of a smaller size than the relieved portions so that the block or blocks may more easily be welded to the core.

The hanger bar may be formed by co-extruding the core in a container of copper. The container is preferably sealed, and preferably the extrusion takes place at a temperature in the range 600°–800° C. The hanger bar may be cold drawn to a final shape subsequent to the extrusion step.

The present invention also provides an electrolytic cell incorporating a cathode and hanger bar assembly as hereinabove described. The cell may be an electrowinning cell with a non-consumable or semi-consumable anode, or an electrorefining cell with a consumable anode. There may be a plurality of anodes and cathodes in the cell.

The present invention still further provides a method of carrying out an electrolytic process which comprises the steps of locating an anode and a cathode of the type hereinabove described in a solution containing ions of an electrodepositable metal connecting the cathode negatively with respect to the anode and passing a current through the anode and cathode to deposit the metal on the cathode and removing the deposited metal from the cathode.

BRIEF DESCRIPTION OF THE DRAWINGS

By way of example, embodiments of the present invention will now be described with reference to the accompanying drawings of which.

DESCRIPTION OF THE PRIOR ART

Figure 1:
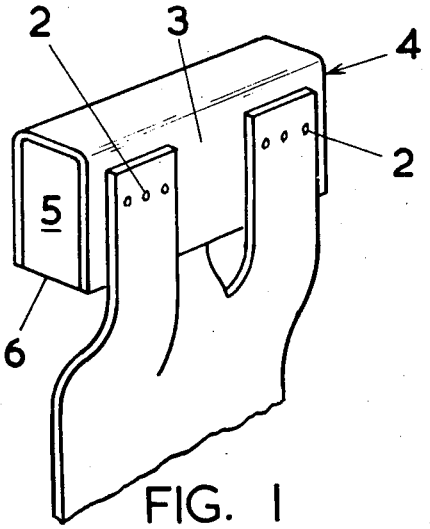
FIG. 1 PRIOR ART
FIG. 1 is a part-perspective view of a prior art cathode.
Figure 2:
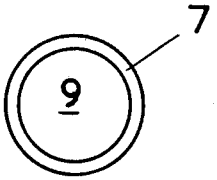
FIG. 2 PRIOR ART
FIG. 2 is a cross-section of a prior art extrusion billet.

Referring to FIG. 1, this shows a titanium cathode sheet but which is spot-welded at 2 to an outer titanium sheet 3 of a copper cored hanger bar, indicated generally at 4. The copper core 5 is metallurgically bonded to the titanium sheath 3. This structure provides a very good and durable cathode but it does have certain problems as are explained above. Firstly, the end of the hanger bar has to be machined as at 6 to remove the titanium sheath to permit contact between the copper core 5 of the hanger bar 4 and the electrical supply busbar on which the hanger bar 4 rests.

Figure 3:
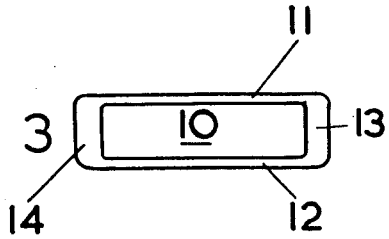
FIG. 3 PRIOR ART
FIG. 3 is a cross-section of a prior art extruded hanger bar.
Figure 5:
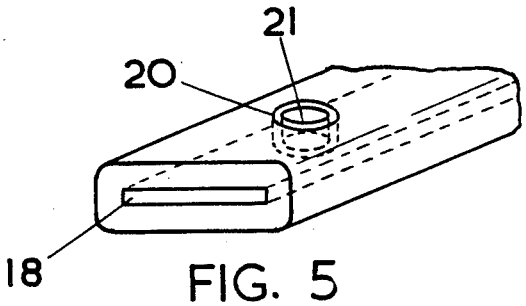
FIGS. 5 and 6 are part perspective views of hanger bars of further embodiments of the invention.

To manufacture the hanger bar, a titanium tube 7 is placed around a copper billet 9 and is put inside a copper can which is then sealed. The circular cross-section billet is then extruded to form the rectangular hanger bar shaped as shown in FIG. 3. The extrusion is carried out at an elevated temperature to form a metallurgical bond between the copper and the titanium. Because of the temperature at which extrusion occurs, the copper core 10 is in the fully annealed condition after extrusion. The titanium sheath is required mainly at the sides 11 and 12 of the hanger bar where spot-welding is to occur. Only a relatively thin amount of titanim or none at all is needed at the ends of the hanger bar shape. However, as can be seen, the amount of titanium at the ends 13 and 14 is greater than at the positions 11 and 12 as a natural consequence of the extrusion process. This excess titanium is effectively wasted. The rolling of the thick titanium tube and the subsequent canning extrusion is of course a relatively expensive method of producing tube but is the only one feasible for the thicknesses required.

Figure 8:
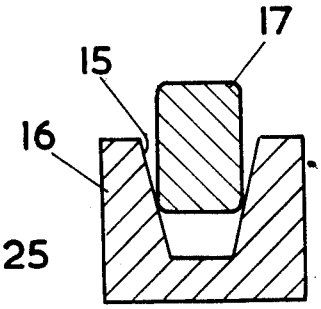
FIG. 8 is a cross-section of a Baltimore groove.

As explained above, the titanium has to be machined away at the ends of the hanger bar to permit contact with the electrical busbars of the electrolytic cell in which the cathode is eventually used. Not all electrolytic cells use busbars, however, and an alternative form of electrical supply is the so-called Baltimore groove which is shown in cross-section in FIG. 8. The groove is a tapered groove 15 formed in a block of copper 16 and the hanger bar rests in the groove as shown at 17 so that contact is made between both sides of the groove and the corners of the hanger bar. For efficient contact, the contact has to be a copper to copper contact and hence the titanium has to be removed over both surfaces of the copper which make contact with the sides of the Baltimore groove. Because the copper has to be of a sufficient width to contact the edges of the groove rather than rest in the bottom, the core 10 of the hanger bar has to be of a width greater than the minimum width of the groove which means that the overall size of the hanger bar has to be larger than might otherwise be necessary.

An additional problem with the prior art cathode is that the hanger bar itself is not sufficiently strong when the copper is in the completely annealed condition. The hanger bar has to be able to support the weight of the cathode and the material deposited on it and also the weight of cell operators walking on top of the hanger bars. To increase the strength of the hanger bar, it is necessary to cold work the copper. Ideally, this would be done by cold drawing the hanger bar since an accurate final dimension can thereby be given to the hanger bar and also the copper core can be cold worked. However, the outer titanium sheath cannot be readily cold drawn because of the galling which occurs when titanium is drawn through a die. Although the hanger bar could be cold drawn with its outer copper layer acting as a lubricant straight after the extrusion stage, it would be necessary to form the bar with some point to start the drawing operation and this can only be conveniently done by machining the outer layers of the bar which remove the lubricating copper layer. Thus, once drawing starts, galling will occur.

DESCRIPTION OF THE PREFERRED EMBODIMENTS

Figure 4:
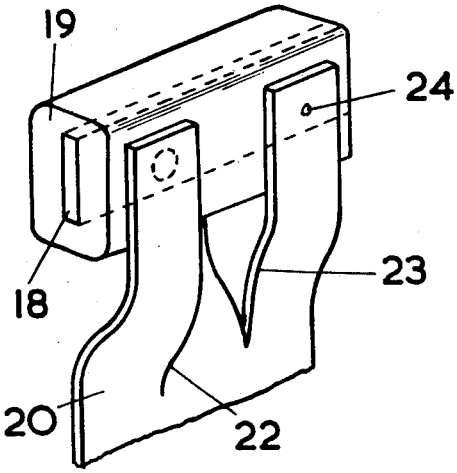
FIG. 4 is a part perspective view of a cathode and hanger bar of one embodiment of the invention.
Figure 7:
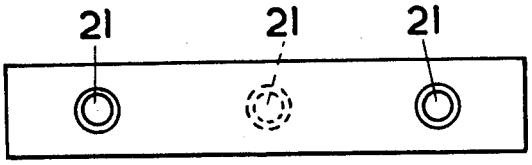
FIG. 7 is a side elevation of a hanger bar of the invention.
Figure 6:
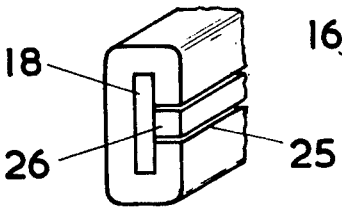

These problems are overcome by the hanger bar and cathode of the invention which adopts the unexpected solution of placing the film-forming metal inside the copper hanger bar. To produce the product, a copper billet has inserted into it a rod of titanium and the copper billet is then sealed. The sealing may be done by welding a copper plate across the ends of the copper billet. Because of the difficulties of welding copper to copper, where one copper item is large, an annular groove may be machined in the end of the copper billet to leave a small web to which the copper is welded. Because the titanium bar can be machined to an accurate diameter and because the copper billet can be furnished with an accurately machined hole, the titanium bar can be made to be a close fit inside the copper billet so that evacuation or argon filling is unnecessary. The billet can then be extruded as though it were a normal copper billet at an elevated temperature to form the hanger bar shown in FIG. 4. The hanger bar comprises a central rectangular core 18 of titanium metallurgically bonded inside a rectangular body 19 of copper. To permit the titanium cathode working surfaces 20 to be welded at one edge to the hanger bar, the copper is removed at a series of holes along its length as at 20 and small blocks of titanium 21 are spot-welded onto the core 18. The titanium cathode working surface is then split as at 22 and 23. The tongues left by the splits are then bent and staggered as shown so that the free ends of the tongues may be spot-welded as at 24 to the blocks 21.

An alternative method of forming the joint is to machine a groove 25 along the entire length of the hanger bar and to spot-weld a strip 26 inside the groove to the titanium core 18. The sheet of one or both sides of titanium forming the cathode may then be welded to the strip 26.

Figure 11:
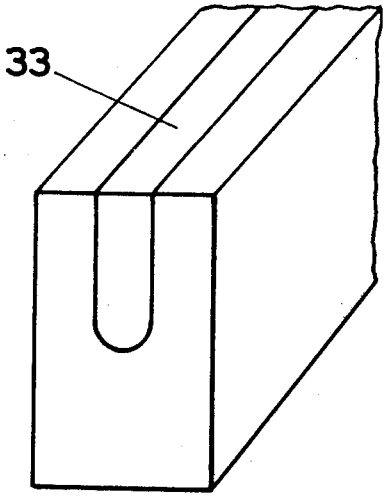
FIG. 11 is a cross-sectional part-perspective view of a hanger bar which has been longitudinally cut.
Figure 12:
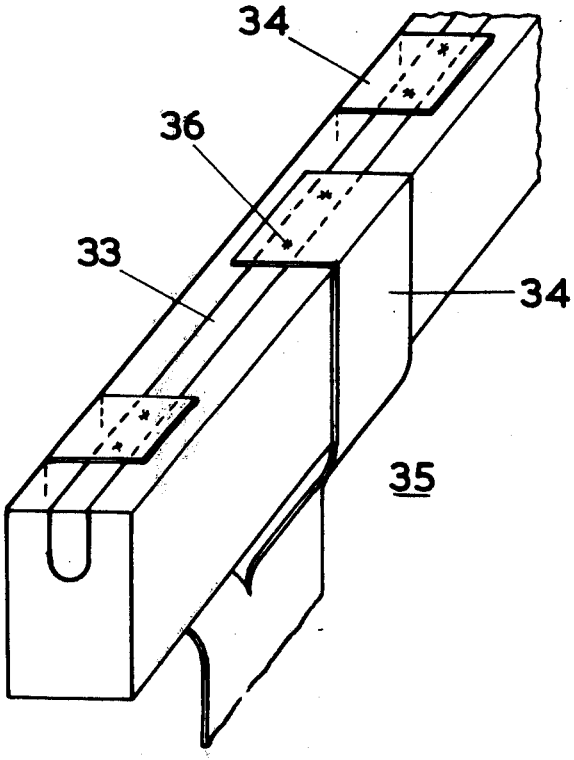
FIG. 12 is a part-perspective view of a hanger bar and cathode sheet.

A further alternative form of manufacturing the cathode is to co-extrude a titanium slab 30 in a copper block 31. The block is then cut longitudinally along the line 32 to form two halves and to expose a free edge 33 of titanium. The product after the cutting stage is shown in FIG. 11. It can be seen that it is then a simple matter to weld cranked staggered legs 34 of a continuous sheet of titanium 35 directly to the edge 33 by spot-welds such as at 36. Alternatively, the titanium cathode sheet may simply have a right-angled bend and be spot-welded directly to the surface 33 so that in use it hangs directly from the surface.

Figure 13:
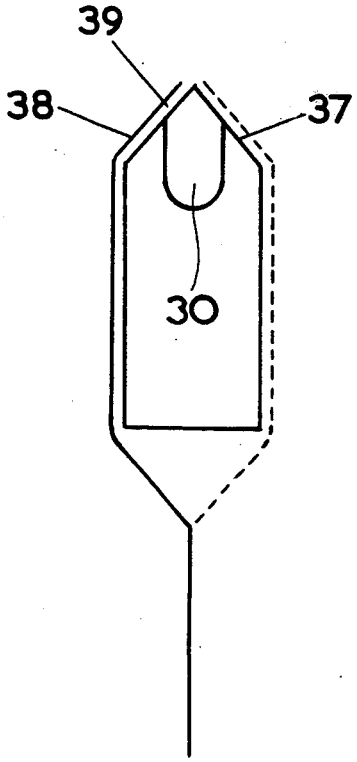
FIG. 13 is an end elevational view of an alternative form of hanger bar.

In a further form of the embodiment as shown in FIG. 13, the product shown in FIG. 11 is machined to form a roof-shaped surface 37 which eases the forming problems associated with the staggered legs 38. The legs 38 are spot-welded as at 39 to the titanium 30.

Figure 9:
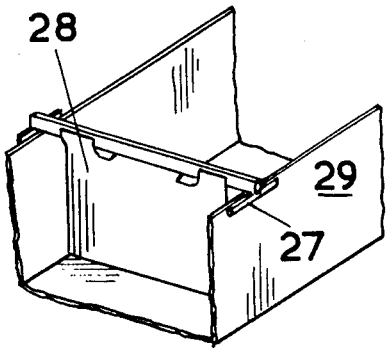
FIG. 9 is a perspective part-sectional view of an electrolytic cell containing a cathode only.
Figure 10:
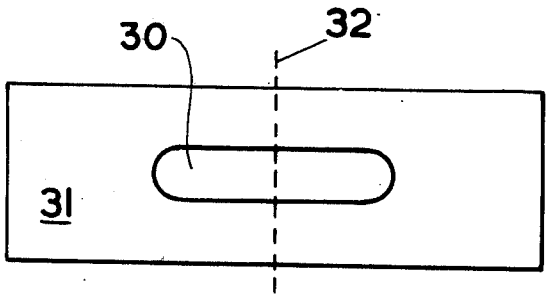
FIG. 10 is an end view of an alternative form of hanger bar prior to final formation.

The product may require less titanium and may be a cheaper form of cathode to manufacture, requires less complicated assembly and extrusion technology and is therefore cheaper to make. Additionally, the hanger bar can be cold drawn to give any required final shape and can thus be used for any particular requirement. Also, since the copper is on the outside, it is readily usable with the Baltimore groove 16 (FIG. 8) or with a conventional busbar 27 as shown in FIG. 9. In FIG. 9, cathode 28 is shown is situ in an electrorefining cell 29. The cell will also contain consumable anodes (not shown for reason of clarity).

It will be appreciated that aluminum may be used instead of copper and it will also be appreciated that other film-forming metals may be used instead of titanium although titanium is preferred since it is cheaper than any other film-forming metal.

It will also be appreciated that a number of further modifications may be made to the arrangement described without falling outside the scope of the invention. For example, the copper sheath may be relieved by milling a transverse strip from a part of the surface. A number of hanger bars may be manufactured in a single operation by gang milling a series of bars across their width. It will also be appreciated that to ease the separation of the titanium, a pair of titanium members may be extruded within a copper sheath so as to form a break in the extruded product and the copper may be removed locally to reveal the break to form two hanger bars from a single extruded product.

I claim:

1. A cathode and hanger bar assembly comprising a two-component hanger bar having a substantially central core of a film forming metal selected from the group consisting of titanium, niobium, zirconium, tantalum, hafnium and alloys thereof and an outer sheath of aluminum or copper metallurgically bonded to the core, the aluminum or copper being relieved along the length of the hanger bar to reveal the film forming metal core and a continuous sheet of a film forming metal welded along one edge only to at least part of the film forming metal core.

2. An assembly as in claim 1 wherein the continuous sheet is welded to an intermediate block or blocks, the block or blocks being welded to the core.

3. An assembly as in claim 2 wherein the block or blocks are of smaller size than the relieved portions to facilitate welding of the block or blocks to the core.

4. An assembly as in claim 1 wherein the aluminum or copper is relieved at discrete locations along the length of the hanger bar.

5. An assembly as in claim 1 wherein the aluminum or copper is relieved along the entire length of one or both sides of the hanger bar.

6. An assembly as in claim 1 wherein the hanger bar is formed by co-extruding the core in a container of copper.

7. An assembly as in claim 6 wherein the container is sealed and in which extrusion takes place at a temperature in the range 600° to 800° C.

8. An assembly as in claim 6 wherein the hanger bar is cold drawn to final shape subsequent to the extrusion step.

9. An electrolytic cell incorporating a cathode and hanger bar assembly as claimed in claim 1.

10. A method of carrying out an electrolytic process which comprises the steps of locating an anode and a cathode in a solution containing ions of an electrodepositable metal, connecting the cathode negatively with respect to the anode and passing a current through the anode and cathode to deposit the metal on the cathode and remove the deposited metal from the cathode, characterized in that the cathode is in the form of a cathode and hanger bar assembly as claimed in claim 1.

11. A cathode and hanger bar assembly comprising a two-component hanger bar having a single substantially central core of a film forming metal selected from the group consisting of titanium, niobium, zirconium, tantalum, hafnium and alloys thereof and an outer sheath of aluminum or copper metallurgically bonded to the core, the aluminum or copper being relieved along the length of the hanger bar to reveal the film forming metal core and a continuous sheet of a film forming metal welded along one edge only to at least part of the film forming metal core.

12. A cathode and hanger bar assembly comprising a hanger bar of aluminum or copper having a substantially central core of a film forming metal selected from the group consisting of titanium, niobium, zirconium, tantalum, hafnium and alloys thereof and an outer sheath of aluminum or copper metallurgically bonded thereto, the aluminum or copper being relieved along the length of the hanger bar to reveal the film forming metal and a continuous sheet of a film forming metal welded along one edge only to at least one intermediate block of film forming metal which is welded to the core.

13. A cathode and hanger bar assembly comprising a hanger bar of aluminum or copper having a single substantially central core of a film forming metal selected from the group consisting of titanium, niobium, zirconium, tantalum, hafnium and alloys thereof and an outer sheath of aluminum or copper metallurgically bonded thereto, the aluminum or copper being relieved along the length of the hanger bar to reveal the film forming metal and a continuous sheet of a film forming metal welded along one edge only directly to at least part of the film forming metal core.

* * * * *